US005580483A

United States Patent [19]

Hamid

[11] Patent Number: 5,580,483

[45] Date of Patent: Dec. 3, 1996

[54] SYNTHETIC BREAK-IN LUBRICANT FOR A REFRIGERATION COMPRESSOR

[75] Inventor: Sibtain Hamid, Somerville, N.J.

[73] Assignee: Huls America Inc., Somerset, N.J.

[21] Appl. No.: 485,720

[22] Filed: Jun. 7, 1995

[51] Int. Cl.[6] ..... C10M 129/52

[52] U.S. Cl. ..... 508/480; 508/481; 508/482; 508/496

[58] Field of Search ..... 252/68, 56 R, 252/57

[56] References Cited

U.S. PATENT DOCUMENTS

| | | | |
|---|---|---|---|
| 4,755,316 | 7/1988 | Magid et al. . | |
| 4,948,525 | 8/1990 | Sasaki et al. . | |
| 5,342,533 | 8/1994 | Kondo et al. | 252/68 |
| 5,391,311 | 2/1995 | Ishida et al. . | |
| 5,391,313 | 2/1995 | Antika et al. . | |
| 5,395,544 | 3/1995 | Hagihara et al. . | |
| 5,452,586 | 9/1995 | Hamid | 252/68 |

*Primary Examiner*—Jacqueline V. Howard
*Attorney, Agent, or Firm*—Abelman, Frayne & Schwab

[57] ABSTRACT

Certain organic diesters and triesters have been found to be useful as a break-in lubricant compressors used in conjunction with HFC-based refrigeration systems. These include compositions of the formula: $R_1OOC—Q—COOR_2$,

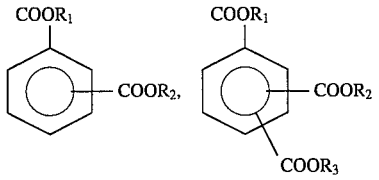

and mixtures thereof, wherein Q is a straight- or branched-chain hydrocarbon group having from 2 to 10 carbon atoms and $R_1$, $R_2$ and $R_3$ can be the same or different and are straight- or branched-chain hydrocarbon groups containing from 6 to 13 carbon atoms. In use as a break-in lubricant, the break-in lubricant is added and the compressor is run for about 1 to 4 hours. This lubricant is then drained.

15 Claims, No Drawings

SYNTHETIC BREAK-IN LUBRICANT FOR A REFRIGERATION COMPRESSOR

FIELD OF THE INVENTION

This invention relates to a synthetic oil comprising organic diester- or organic triester-based fluids, or mixtures thereof, useful as a break-in lubricant or general purpose lubricating preservative oil for parts for refrigeration systems using non-chlorinated HFC refrigerants and polyol ester compressor lubricant.

BACKGROUND OF THE INVENTION

Traditionally, chlorofluorocarbon (CFC) and hydrochlorofluorocarbon (HCFC) type refrigerants, such as CFC-11 (trichloromonofluoromethane), CFC-12 (dichlorodifluoromethane) and HCFC-22 (monochlorodifluoromethane) among others, have been used as refrigerants in refrigerators, air conditioners, chillers, commercial buildings and other appliances. These chlorine-based refrigerants are believed to destroy the ozone layer and therefore their use is to be gradually eliminated by 1996, under a recent protocol signed in Montreal, Canada by representatives of 167 countries of the world.

Chlorine-free hydrogen-containing halocarbons have already been introduced to replace CFC- and HCFC-type refrigerants. Hydrofluorocarbons (HFC), such as HFC-134 (1,1,2,2-tetrafluoroethane) and HFC-134a (1,1,1,2-tetrafluorethane), are considered to be direct replacements for CFC-12 (also known as R-12) refrigerant. The cooling (thermodynamic) properties of HFC-134a are similar to those of the R-12 product in many applications and HFC-134a appears to have emerged as the currently preferred HFC refrigerant.

Historically, mineral oils, particularly naphthenic mineral oils, and alkylbenzenes, have been used as lubricants with the CFC-type refrigerants. Such mineral oils, however, exhibit poor miscibility with HFC-type refrigerants. The resulting HFC/mineral oil mixture has been found to separate into two layers at ambient temperature. This results in the oil clogging in the cold temperature (evaporators) areas, thus restricting the refrigerant flow and causing poor oil return to the compressor, and it results in reduced efficiency. The lack of an effective lubricant to the compressor can also cause bearing seizure, and eventually compressor breakdown will occur.

Synthetic oils, such as polyalkylene glycol- and polyol ester-type refrigeration oils, have heretofore been introduced as lubricants for HFC-based systems. They have excellent miscibility with HFC-134a. See, for example, U.S. Pat. Nos. 4,948,525 and 4,755,316, which are hereby incorporated herein by reference in their entirety. These synthetic oils perform well in lubricating the compressor bearings.

In addition to the aforementioned problems with using naphthenic-based mineral oils as lubricants with HFC-type refrigerants, they further cannot be used as a compressor break-in lubricant or general purpose lubricating preservative oil for parts during compressor assembly. Although the amount of break-in lubricant left in the compressor after break-in is small, even such small amounts can cause miscibility and or thermal stability problems in systems using HFC-type refrigerants and synthetic polyol ester lubricants.

Using a synthetic polyol ester break-in lubricant or parts lubricant avoids compatibility problems caused by the HFC-type refrigerants; however, polyol esters are hygroscopic.

The compressor parts that have been lubricated with oils are exposed to the atmosphere for an extended period of time during compressor assembly. The break-in lubricant is also exposed to the atmosphere during repeated use of the same oil for several break-ins, as is the normal procedure. Hygroscopic oils, such as polyol esters, will adsorb moisture from the atmosphere. Adsorbed moisture is thus introduced into the compressor, which can cause corrosion of compressor parts. Due to their hygroscopic nature, polyol esters are therefore not suitable for use as a break-in lubricant or general purpose parts lubricant.

Thus, there is a need for a lubricant for use with systems using HFC-type refrigerants and synthetic polyol ester lubricants.

SUMMARY OF THE INVENTION

A method for breaking in a compressor that uses HFC-type refrigerant and polyol ester lubricant is disclosed. According to the invention, the method comprises using certain organic diesters and organic triesters that are less hygroscopic than polyol esters and which have excellent miscibility at low concentrations with hydrofluorocarbons such as, for example, HFC-134a. Furthermore, such diesters and triesters are also miscible with polyol esters, alkylbenzenes and polyalkylene glycols. These diesters and triesters also have good wetting characteristics, lubricity and affinity for metal surfaces, which are useful properties for break-in.

DETAILED DESCRIPTION OF THE INVENTION

According to the present invention, a break-in lubricant comprising certain organic diesters and triesters is added to the lubricating oil port of a refrigeration system compressor of an HFC-based refrigeration system. The compressor is run for a period of time, typically one to four hours, that is long enough to check compressor performance, and then the break-in lubricant is drained. The lubricant for use during normal operation, typically a polyol ester, is then added.

The organic diesters and triesters useful in the method of the invention are miscible at proportions up to 30% with the polyol esters and with the HFC-type refrigerants, such as R-134 or R-134a. Compositions of 0–30% wt. diester or triester and 70–100% wt. polyol esters have been found to be miscible with HFC refrigerants over the temperature range of −40° C. to +80° C. This property is considered by those of ordinary skill in the art to be perhaps the primary requirement for identification of useful refrigeration lubricants. Organic esters made from the reaction of certain straight- or branched-chain dicarboxylic acids and certain straight- or branched-chain alcohols are useful.

Diesters and triesters useful for practicing the present invention can have the general formula: $R_1OOC—Q—COOR_2$,

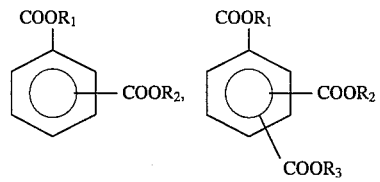

where Q is a straight- or branched-chain alkyl group having from 2 to 10 carbon atoms and $R_1$, $R_2$ and $R_3$ can be selected independently from straight- or branched-chain hexyl, heptyl, octyl, nonyl, decyl, undecyl, dodecyl and tridecyl groups. Preferably, Q is a butyl ($C_4$) group and $R_1$, $R_2$ and $R_3$ are branched-chain octyl ($C_8$) groups. Mixtures of the useful diesters and triesters can also be used.

Diesters and triesters useful in the method of the present invention can be synthesized by methods well known to those of ordinary skill in the ester-synthesis art. For example, useful diesters can be prepared by direct esterification of dicarboxylic acids such as phthalic acids or adipic acids with an equivalent amount of alcohol in the presence of a catalyst such as sulfuric acid. Furthermore, prepared di- or tri-esters can be blended together to obtain desired properties, for example, viscosity. These di-and tri-esters have been successfully used since about 1941 in many other applications, and are especially useful in air-compressor applications where low quantities of degradation products together with adequate amounts of lubricity are highly desirable. These compositions have a long history of excellent performance in reciprocating vane and rotary type applications. In these prior applications, the compressor lubricants come into contact with the gases that are being compressed or cracked, e.g., hydrogen, methane, ethane and ethylene, without deleterious effect. These latter groups are in the backbone of some new refrigerants, such as R-134a.

Esters useful in the present invention include for example, without limitation: dioctyl adipate (DOA); diisooctyl adipate (DIOA); diisodecyl adipate (DIDA); ditridecyl adipate (DTDA); dioctyl azelate (DOZ); dioctyl phthalate (DOP); diisooctyl phthalate (DIOP); diisodecyl phthalate (DIDP); ditridecyl phthalate (DTDP); dioctyl sebacate (DOS); triisodecyl trimellitate (TIDTM); triisooctyl trimellitate (TIOTM); trioctyl trimellitate (TOTM), and mixtures thereof. Preferred are diisooctyl adipate (DIOA), ditridecyl adipate (DTDA), trioctyl trimellitate (TOTM), and mixtures thereof. Other organic diesters and triesters can also be used.

The diesters and triesters useful for practicing the present method, e.g., DIOA and TOTM, can be combined with antiwear agents such as, without limitation, tricrysl phosphate, triaryl phosphate and tributoxy ethyl phosphate. Further, such diesters and triesters can be used with corrosion inhibitor such as, without limitation, sodium sulphonate, calcium sulphonate and barium sulphonate. Also, oxidation inhibitors such as, without limitation, phenyl-alpha naphthylamine, 2,6-di-tertiarybutyl-para-cresol and p,p-dioctyldiphenylamine can be used with the diesters and triesters useful for practicing the present invention. In addition, a metal deactivator such as benzotriazol can be added to prevent corrosion of any copper tubing present in a refrigeration circuit.

Tables I and II below illustrate the wear performance and corrosion protection properties, respectively, of the method according to the present invention. A lubricant was prepared which contained diisooctyl adipate and triisodecyl trimellitate. The lubricant was used to break-in a new compressor and further used to coat compressor parts.

TABLE I

| Wear Performance | | |
|---|---|---|
| Tests | ASTM # | Results |
| Falex, lbs to failure | D 3222 | 1000 lbs |
| 4-Ball Wear Test | | |
| (20 kg, 75° C., 1200 rpm) | D 2266 | 0.50 mm |
| (40 kg, 75° C., 1200 rpm) | D 2266 | 0.62 mm |

TABLE II

| Corrosion Protection Properties | | |
|---|---|---|
| Tests | ASTM # | Results |
| Rust Test Proc. A Degree of Rust, % | D 665 | Zero |
| Rust Test Proc. B Degree of Rust, % | D 665 | Zero |
| Copper Corrosion | D 130 | lb |
| Humidity Cabinet | D 1748 | >336 hours |
| Steel Corrosion* (24 hrs. @ 100° C.) | | No Corrosion |
| Compressor Parts* (50% humidity, ambient temp., 14 days) | | |
| Wrist pin | | No Corrosion |
| Connecting Rod | | No Corrosion |
| Valve Cover | | No Corrosion |

*Specimens dipped in lubricant and hung on a rack.

The invention is further illustrated by the following non-limiting examples:

EXAMPLE I

A lubricant was prepared containing 98.45 percent by weight diisooctyl adipate and 0.05 percent by weight Benzotriazol copper deactivator. The lubricant had a pour point of −60° C., a viscosity of 9.4 cSt at 40° C. and a viscosity index of 142.

The lubricant was used to break-in a new ¼ hp compressor manufactured by Tecumseh Products Co. of Tecumseh, Mich. The compressor was charged with 400 ml of break-in lubricant as described above and run for four hours. A naphthenic mineral oil was used to break-in an identical ¼ hp compressor following the same procedures. Upon shutdown, both compressors were opened to examine the parts, in particular the wrist-pin and connecting rod. No wear was indicated for the parts from either compressor and no corrosion was evident.

EXAMPLE II

A lubricant was prepared containing 20 percent by weight diisooctyl adipate, 78.45 percent by weight triisodecyl trimellitate, 0.5 percent by weight phenylalphanaphthylamine, 1.0 percent by weight petroleum sulphonate and 0.05 percent by weight Benzotriazol. The lubricant had a pour point of −55° C. and a viscosity of 32 cSt at 40° C.

The lubricant was used to break-in a new ¼ hp compressor manufactured by Tecumseh Products Co. The compressor was charged with 400 ml of break-in lubricant as described above and run for twenty-four hours. ISO-32 naphthenic mineral oil was used to break-in an identical ¼ hp compressor following the same procedures. Upon shutdown, both compressors were opened to examine the parts, in particular the wrist-pin and connecting rod. No wear was indicated for the parts from either compressor and no corrosion was evident.

EXAMPLE III

A new ¼ hp hermetically sealed compressor manufactured by Tecumseh Products Co. was cut open. The parts from the compressor, such as the connecting rod, wrist pin and cover valve were washed with a neutral solvent, e.g., hexane. The compressor parts were then dried and a coating of the lubricant prepared in EXAMPLE II was applied. The parts were exposed to 50 percent relative humidity and ambient temperature for 30 days. After 30 days, the parts were examined under a microscope at 20× and no corrosion was observed.

What is claimed is:

1. A method for initial lubrication of a compressor useful in refrigeration systems comprising the steps of:

(a) adding a charge of a break-in lubricant to a lubricating oil receptacle of a refrigeration system, (b) running the system for a period of time which is sufficient to allow compressor operation to be checked, and (c) draining the charge of the break-in lubricant, wherein the break-in lubricant comprises a composition selected from the group consisting of: $R_1OOC—Q—COOR_2$,

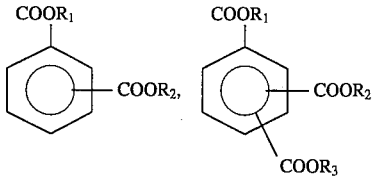

and mixtures thereof, wherein Q is a straight- or branched-chain hydrocarbon group having from 2 to 10 carbon atoms and $R_1$, $R_2$ and $R_3$ can be the same or different and are straight- or branched-chain hydrocarbon groups containing from 6 to 13 carbon atoms.

2. The method of claim 1 wherein Q is a butyl group and $R_1$, $R_2$ and $R_3$ are each branched-chain hydrocarbon groups having 8 carbon atoms.

3. The method of claim 1 wherein the step of adding a charge of break-in lubricant further comprises adding one or more of dioctyl adipate, diisooctyl adipate, diisodecyl adipate, ditridecyl adipate, dioctyl azelate, dioctyl phthalate, diisooctyl phthalate, diisodecyl phthalate, ditridecyl phthalate, dioctyl sebacate, triisodecyl trimellitate, triisooctyl trimellitate and trioctyl trimellitate.

4. The method of claim 1 wherein the step of adding a charge of a break-in lubricant further comprises adding an antiwear agent.

5. The method of claim 4 wherein the antiwear agent is selected from the group consisting of tricrysl phosphate, triaryl phosphate and tributoxy ethyl phosphate.

6. The method of claim 1 wherein the step of adding a charge of a break-in lubricant further comprises adding a corrosion inhibitor.

7. The method of claim 6 wherein the corrosion inhibitor is selected from the group consisting of sodium sulphonate, calcium sulphonate and barium sulphonate.

8. The method of claim 1 wherein the step of adding a charge of a break-in lubricant further comprises adding an oxidation inhibitor.

9. The method of claim 8 wherein the oxidation inhibitor is selected from the group consisting of phenyl-alpha naphthylamine, 2,6-di-tertiarybutyl-para-cresol and p,p-dioctyldiphenylamine.

10. The method of claim 1 wherein the step of adding a charge of a break-in lubricant further comprises adding a metal deactivator.

11. The method of claim 10 wherein the metal deactivator is benzotriazol.

12. The method of claim 1 wherein the period of time is about 1 to about 4 hours.

13. The method of claim 1 wherein the refrigeration system comprises hydrofluorocarbons.

14. A method for initial lubrication of a compressor useful in refrigeration systems comprising the steps of:

(a) adding a charge of a break-in lubricant to a lubricating oil receptacle of a refrigeration system, which break-in lubricant comprises esters from the group consisting of diisooctyl adipate, ditridecyl adipate, trioctyl trimellitate and mixtures thereof, (b) running the system for a period of time which is sufficient to allow compressor operation to be checked, and (c) draining the charge of the break-in lubricant.

15. The method of claim 14 wherein the step of adding a charge of a break-in lubricant further comprises adding at least one additive selected from the group consisting of an antiwear agent, a corrosion inhibitor, an oxidation inhibitor and a metal deactivator.

* * * * *